United States Patent [19]

Stupka

[11] Patent Number: 4,636,170

[45] Date of Patent: Jan. 13, 1987

[54] KILN FURNITURE SETTER

[76] Inventor: David Stupka, P.O. Box 73, New Bedford, Pa. 16140

[21] Appl. No.: 839,186

[22] Filed: Mar. 13, 1986

[51] Int. Cl.[4] ..... F27D 1/12; F27B 9/26

[52] U.S. Cl. ..... 432/258; 432/259; 264/58; 198/624; 198/482.1; 198/803.14

[58] Field of Search ..... 432/258, 259; 264/57-59; 198/624, 482.1, 803.14

[56] References Cited

U.S. PATENT DOCUMENTS 1,860,374 5/1932 Vincent ..... 432/259

2,910,962 11/1959 Appelton ..... 432/259

4,184,841 1/1980 Robinson et al. ..... 432/259

4,504,224 3/1985 Hewitt ..... 432/259

*Primary Examiner*—Henry C. Yuen

*Attorney, Agent, or Firm*—Harpman & Harpman

[57] ABSTRACT

A kiln furniture setter used to support and transport greenware into a kiln to be fired comprising a multiple column support structure with sequential rotation of supports to eject greenware from said supports by the rotation of the support columns in respect to horizontal movement of the carrier on a conveyor belt.

4 Claims, 4 Drawing Figures

KILN FURNITURE SETTER

BACKGROUND OF THE INVENTION

1. Technical Field

This invention relates to kiln furniture setters that support and separate ceramic greenware to be fired in a kiln.

2. Description of the Prior Art

Prior art devices of this type have been used to support greenware in spaced relation within a kiln. See for example U.S. Pat. Nos. 224,450, 1,333,380 and 1,870,374.

In U.S. Pat. No. 224,450, a pottery-ware support system is disclosed wherein a circular fixture is shown having a plurality of vertically spaced horizontally extending posts within that support to engage and hold ceramic ware thereon. U.S. Pat. No. 1,333,380 shows a support for tableware having three posts configuration in which each has horizontally extending posts supported thereon.

U.S. Pat. No. 1,860,374 discloses a support device for tableware in a kiln having multiple post configurations that stack one upon the other to form vertically ascending space supports. Each portion can be rotated exposing a new post to support the tableware.

SUMMARY OF THE INVENTION

A kiln furniture setter for holding and transporting ceramic ware into and out of a kiln for firing. The present device has rotatable support columns that in turn hold the ware. By sequential engagement and rotation of the columns, the ware can be removed automatically from the device after firing.

DESCRIPTION OF THE PREFERRED EMBODIMENT

Figure 1:
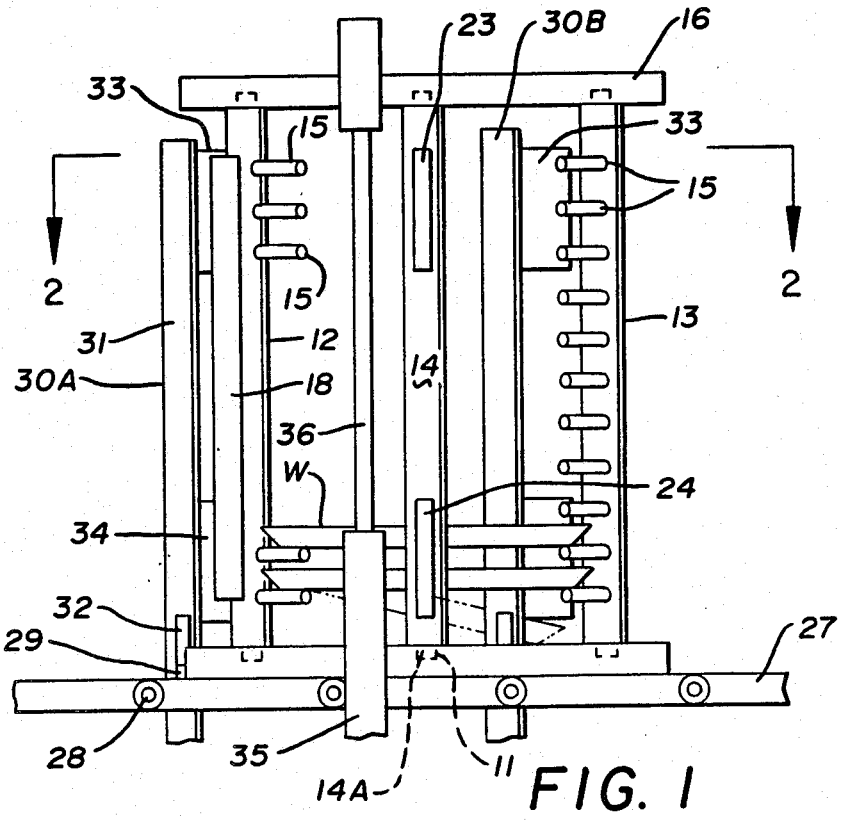
FIG. 1 is a side plan view of the setter on a conveyor belt loaded with greenware to be fired.
Figure 2:
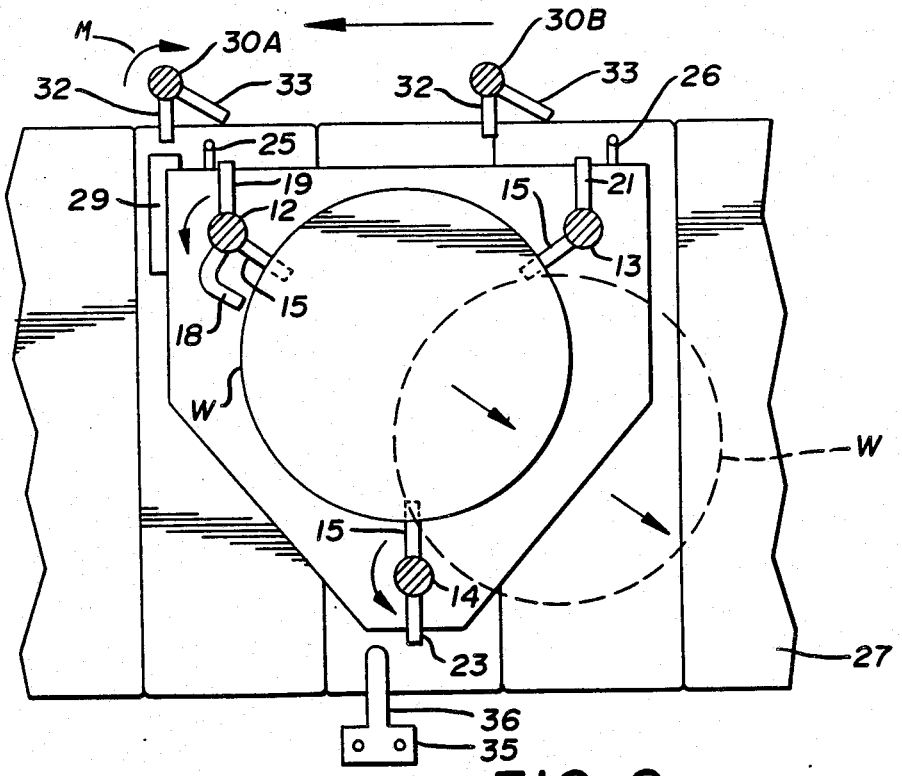
FIG. 2 is a sectional view on lines 2—2 of FIG. 1 showing the relative position of the ware and the rotatable support columns mechanism.
Figure 3:
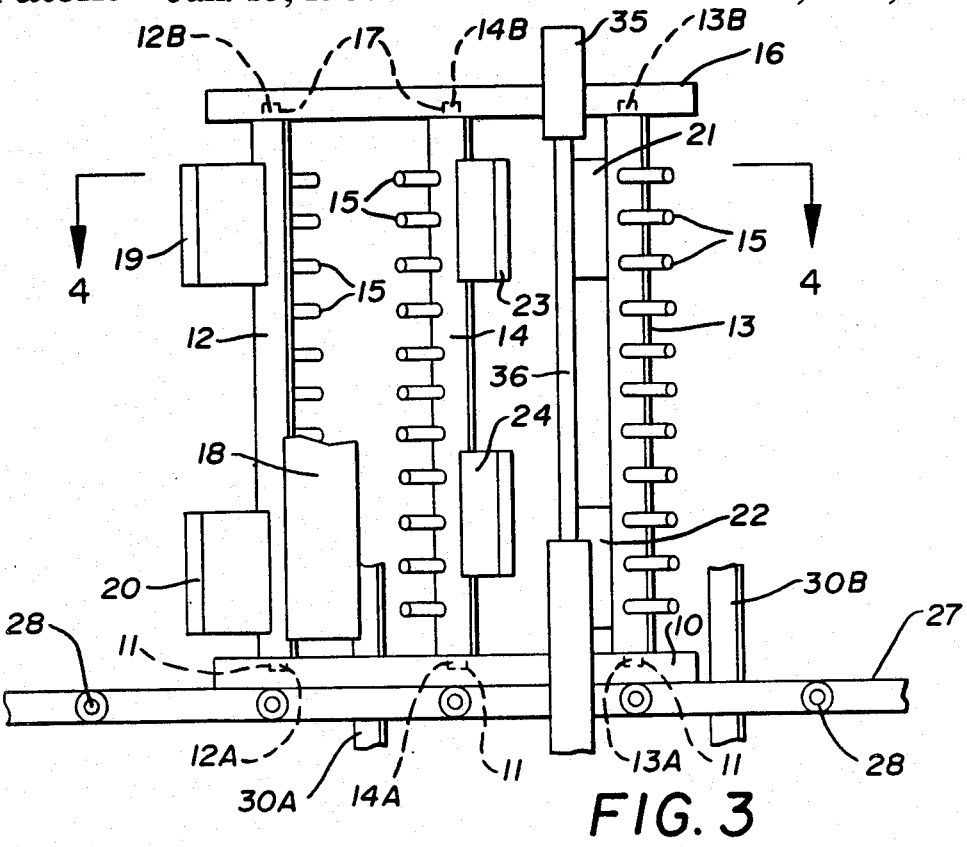
FIG. 3 is a side plan view of the setter after engagement and partial ejection of the ware.

Referring now to FIGS. 1 and 2 of the drawings, a kiln furniture and transfer setter can be seen having a centrally apertured base 10 with a plurality of spaced receptacles 11 within. Support columns 12, 13 and 14 extend from said base 10 rotatably registering within said spaced receptacles 11 by extending tabs 12A, 13A, 14A. Each of said support columns has a plurality of vertically spaced outwardly extending posts 15. A top member 16 is in oppositely disposed relation to said base and has correspondingly positioned shaped receptacles 17 engaging said support columns via outwardly extending tabs 12B, 13B and 14B as hereinbefore described.

Referring now to column 12 an elongated curved ejection arm 18 extends outwardly therefrom along the majority of the column's vertical height. A pair of vertically spaced oppositely disposed activation flaps 19 and 20 are positioned on the column 12. A secondary pair of vertically spaced oppositely disposed activation flaps 21 and 22 are secured to the column 13 as best seen in FIG. 2 of the drawings.

Figure 4:
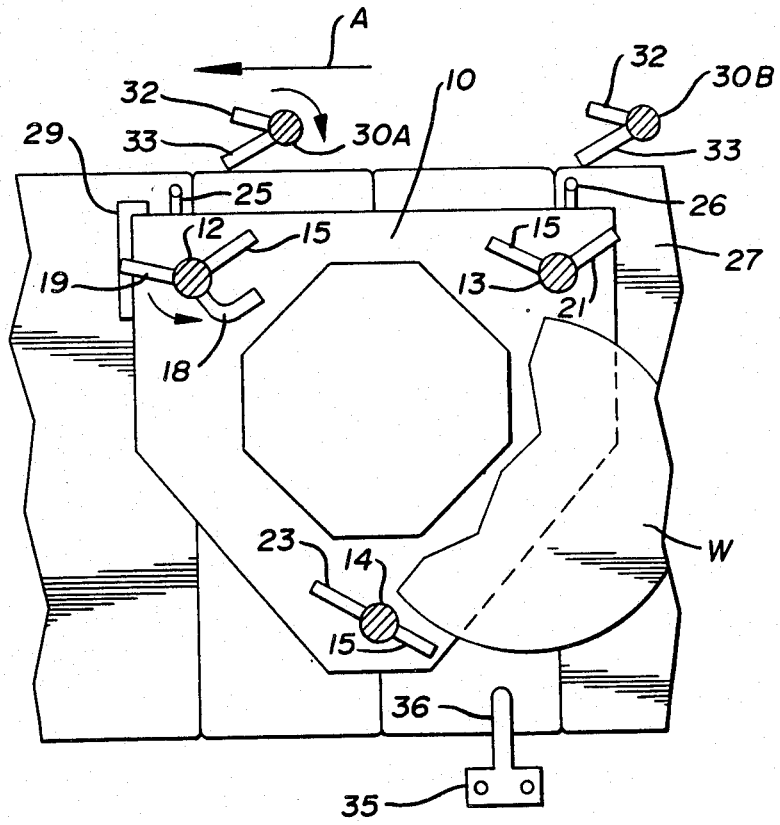
FIG. 4 is a section on lines 4—4 of FIG. 3 showing the ejection of the ware in broken lines.

A third pair of vertically spaced activation flaps 23 and 24 are positioned on the column 14 opposite said outwardly extending post 15. A pair of index posts 25 and 26 extend horizontally from the base 10 as best seen in FIGS. 2 and 4 of the drawings which will sequentially activate the rotation of columns 12 and 13 as will be described in greater detail. The kiln furniture support and transfer setter is positioned on an endless kiln transport belt 27 that has multiple segments secured together by pivot points 28 as will be well understood by those skilled in the art. A kiln furniture position guide 29 is secured to the endless kiln transfer belt 26 and is comprised of a low profile L-shaped base that aligns each kiln furniture on the belt in a desired spacing both vertically and horizontally.

A pair of identical column activators 30A and 30B are free-standing beside the endless belt adjacent the columns 12 and 13 as they pass by on the endless belt 27 which is moving from right to left as indicated by the arrows in FIGS. 2 and 4 of the drawings.

Each of the column activators 30 is comprised a free rotating rod 31 having an engagement member 32 extending outwardly therefrom in horizontal alignment with the index parts 25 and 26.

A pair of vertically spaced paddles 33 and 34 extend from the column activator 30 and are angularly disposed in relation to said engagement members 32. The paddles 33 and 34 are positioned and extend from the column activator a distance great enough to be engageable by the activation flaps 19 and 20 respectively in a clockwise fashion indicated by the arrow M. A third column activator 35 is positioned on the opposite side of said endless belt from said column activators 30A and 30B and has a single outstanding paddle 36 that extends vertically the length thereof.

In operation, the kiln furniture setter is positioned on the endless belt 27 as hereinbefore described and loaded with ceramic wear (W) to be fired as best seen in FIG. 1 of the drawings.

After firing, the kiln furniture is transported by the endless belt 27 as seen in FIG. 2 of the drawings in the direction indicated by the arrows A. As the kiln furniture setter moves, the third column activator 35 and its paddle 36 engages the activation flaps 23 and 24 on the column 14 rotating the same on its vertical axis moving said pins 15 thereon out from under the wear W as indicated in broken lines in FIG. 1 of the drawings.

As the kiln furniture setter continues, the index post 25 engages the engagement member 32 on the bottom of the column activator 30A rotating the same with the paddles 33 and 34 moving in a clockwise position to engage the activation flaps 19 and 20 on the column 12 rotating the same in a counterclockwise position wherein the post 15 and the ejection arm 18 rotate the latter engaging the ceramic ware W and moving it outwardly from the kiln furniture setter as seen in FIG. 4 of the drawings.

As the above sequence of movement is underway, the index post 26 engages the engagement member 29 on the column activator 30B rotating the same as hereinbefore described releasing the post 15 on the column 13.

It will be evident to those skilled in the art that a reset mechanism can be supplied so that the column activators 30A and 30B will reposition themselves for engagement with the next kiln furniture setter on the conveyor belt and that the same procedure for activation and removal of the wear can begin.

It will thus be seen that a new and useful kiln furniture device have been illustrated and described and it will be apparent to those skilled in the art that various changes and modifications may be made therein without departing from the spirit of the invention and having thus described my invention,

What is claim is:

1. An improvement to a kiln furniture support and transport setter, the kiln furniture comprising a base having spaced receptacles therein, a top member having spaced receptacles therein, columns positioned between said receptacles and within said receptacles, a plurality of vertically spaced posts extending from each of said columns for holding and spacing of ceramic ware thereon, the improvement comprising means for rotation of said columns from a ceramic wear support position, said means for rotation comprising activation flaps positioned on each of said columns in angularly disposed relation to said posts, means for engaging said activation flaps sequentially from column to column, means for ejecting said ceramic ware from said kiln furniture and wherein said kiln furniture is positioned on a conveyor belt.

2. The improvement to a kiln furniture support and transport setter of claim 1 wherein said means for engaging said activator flaps comprising column activators adjacent said belt having engagement members extending outwardly therefrom along its longitudinal axis, said engagement member in registrable alignment with said activation flaps and are rotatable on said longitudinal axis.

3. The improvement to a kiln furniture support and transport setter of claim 1 wherein said means for ejecting said ceramic ware from said kiln furniture setter comprises an arm extending from one of said columns aligned so as to engage and eject the ceramic ware upon rotation of said column.

4. The improvement to a filn furniture support and transport setter of claim 2 wherein spaced index posts are secured on said kiln furniture sequentially engaging said column activators.

* * * * *